US007309181B2

(12) United States Patent
Hawkins

(10) Patent No.: US 7,309,181 B2
(45) Date of Patent: Dec. 18, 2007

(54) MAGNETIC MOUNT DRY ERASER FOR ACCOMMODATING WRITING UTENSILS

(76) Inventor: Thomas Hawkins, 227 Michigan Ave., #104, Miami, FL (US) 33139

( * ) Notice: Subject to any disclaimer, the term of this patent is extended or adjusted under 35 U.S.C. 154(b) by 81 days.

(21) Appl. No.: 10/998,774

(22) Filed: Nov. 29, 2004

(65) Prior Publication Data

US 2005/0196221 A1 Sep. 8, 2005

Related U.S. Application Data

(60) Provisional application No. 60/550,522, filed on Mar. 5, 2004.

(51) Int. Cl.
*B43K 23/02* (2006.01)

(52) U.S. Cl. ..... 401/131; 401/6

(58) Field of Classification Search ..... 401/6, 401/48, 52, 88, 131, 195; 15/104.92, 209.1, 15/210.1, 231, 232, 426, 443; D19/42
See application file for complete search history.

(56) References Cited

U.S. PATENT DOCUMENTS 2,434,973 A 1/1948 Williams
2,520,085 A 8/1950 Griffin et al.
3,110,917 A * 11/1963 McPeek, Jr. ..... 401/52
3,842,980 A 10/1974 Kushner
4,037,975 A * 7/1977 Huffman ..... 401/6
4,374,225 A * 2/1983 Kawakubo et al. ..... 15/424
4,554,703 A 11/1985 Matuki
4,826,338 A * 5/1989 Kilpatrick ..... 401/35
4,917,517 A * 4/1990 Ertz ..... 401/48
4,937,910 A 7/1990 Frazier
5,037,224 A * 8/1991 Wright ..... 401/48
5,432,973 A * 7/1995 Wagner et al. ..... 15/210.1
5,836,038 A 11/1998 Thorp
6,305,864 B1 * 10/2001 Nguyen ..... 401/131
6,793,430 B1 * 9/2004 Liu ..... 401/131

* cited by examiner

*Primary Examiner*—Tuan Nguyen
(74) *Attorney, Agent, or Firm*—Mark Terry

(57) ABSTRACT

A dry eraser is disclosed including an eraser body having an upper region and a lower region, a layer of erasing material having a top portion and a bottom portion, the top portion affixed to the lower region of the eraser body, at least one socket on the upper region for accommodating at least a portion of a writing utensil, and a magnetic member operatively engaged to the eraser body between the top portion of the layer of erasing material and the upper region of the eraser body.

10 Claims, 5 Drawing Sheets

MAGNETIC MOUNT DRY ERASER FOR ACCOMMODATING WRITING UTENSILS

CROSS-REFERENCE TO RELATED APPLICATIONS

This application claims the benefit of U.S. Provisional Application Ser. No. 60/550,522, filed on Mar. 5, 2004, entitled MAGNETIC MOUNT DRY ERASER FOR ACCOMMODATING WRITING UTENSILS.

TECHNICAL FIELD

The present invention relates to erasers designed to remove ink from dry erase boards. In particular, the present invention is relates to an eraser for dry erase boards that accommodates at least one writing utensil, may be conveniently secured on or in close proximity to any dry erase board, and has writing utensils that are ready to use upon extraction from the eraser.

BACKGROUND OF THE INVENTION

Dry erase boards are well known for providing a convenient and efficient method of temporarily writing information. Dry erase boards are commonly found in popular locations such as refrigerator doors, offices, classrooms, boardrooms, hallways, and reception areas. A dry erase board is written upon with a felt-tipped pen that dispenses ink that dries on the board. The ink used in the pen is a non-permanent type, such that the writing may subsequently be erased. During the erasure process, the ink becomes a loose dust that is subsequently removed from the board by the eraser.

The use of dry erase boards has increased such that it has become common to find various sizes of dry erase boards that are suited for use in specific locations. While dry erase boards are manufactured in a variety of sizes, one factor remains common to most commercial dry erase boards. This commonality is the lack of an eraser suitable for writing utensil availability and access, as well as being proximate to the writing on dry erase boards and allowing for quick and easy access to the writing utensil that is capable of use upon extraction from the eraser. Furthermore, sufficient storage area is provided for accommodating the writing and erasing utensils used to write on the dry erase boards. Frequently, users employ chalkboard erasers or other insufficient means to clean the dry erase board. However, these products are abrasive and will eventually ruin the dry erase board with continued use. Thus, there remains a need for users of dry erase boards to perform erasure functions using a proper eraser that is conveniently located with respect to the dry erase board, accommodates writing utensils, and positions the layer of erasing material against the dry erase board when not in use.

The prior art discloses several types of erasers and holders therefor. For example, U.S. Pat. No. 2,434,973 issued on Jan. 27, 1948 to Williams discloses an eraser with magnetic supporting means. The eraser is specifically suited for making erasures upon papers in a typewriter. The eraser has a circular shape and is mounted about a metal sleeve having magnetic properties.

U.S. Pat. No. 2,520,085 issued on Aug. 22, 1950 to Griffin et al. discloses an eraser and holder. The eraser is contained in the holder that includes magnetic metal. The holder may incorporate a brush to remove eraser and paper dust after erasures have been made.

U.S. Pat. No. 3,842,980 issued on Oct. 22, 1974 to Kushnrer discloses a magnetic supporting means. The device includes a holder composed of magnetically conductive material having bottom and side portions. The device receives a magnetic source member within the holder and proximate its bottom and side portions. The bottom portion of the holder includes means, secured thereto, for attaching the holder to a supporting surface. The holder is composed of metallic material and the member is composed of a flexible plastic material with permanently magnetized ferrite particles embedded therein.

U.S. Pat. No. 4,554,703 issued on Nov. 26, 1985 to Matuki discloses a magnetic eraser dust collector. The device is suited for use with an eraser of rubber composition that includes magnetic particles dispersed therein. The device has a permanent magnet for attracting the magnetic dust created by use of the eraser. The device further includes a shield normally enclosing the magnet for removal of the collected dust. When the shield is held close to or in direct contact to the eraser dust, the magnet attracts the dust to the shield. The dust may be easily disposed by removing the magnet from the shield.

U.S. Pat. No. 4,937,910 issued on Jul. 3, 1990 to Frazier discloses a white board eraser. The eraser is suited for removal of dry ink dust and for conditioning of white boards. The eraser includes a stack of fabric layers of semi-rectangular shape that are fastened to a jacket cover that is folded over a central core. The fabric layers have tab dispensing ends and other tab ends and other tabs fastened to the cover. The layers may be removed one at a time and may be treated with cleaning and anti-static compounds.

U.S. Pat. No. 5,836,038 issued on Nov. 17, 1998 to Thorp discloses an eraser that includes a rigid support member having a layer of non-abrasive material attached to the bottom surface thereof and a strip of magnetic material attached to the top surface thereof. When not in use, the eraser is stored with the magnetic material positioned against a metallic substrate, thereby positioning the layer of non-abrasive material outward toward the user.

None of the above inventions, taken either singularly or in combination, disclose a white board eraser that is conveniently located with respect to the dry erase white board, accommodates writing utensils, positions the layer of erasing material against the dry erase board when not in use, presents the eraser and writing utensil to the user in an ergonomic fashion, and where the writing utensils are capable of use upon extraction from the eraser. Thus a magnetic mount dry eraser solving the aforementioned problems is desired.

SUMMARY OF THE INVENTION

The present invention eliminates the above-mentioned needs for a white board eraser that is conveniently located with respect to the dry erase white board, accommodates writing utensils, positions the layer of erasing material against the dry erase board when not in use, presents the eraser and writing utensil to the user in an ergonomic fashion, and where the writing utensils are capable of use upon extraction from the eraser.

In accordance with the present invention, there is provided a dry eraser including an eraser body having an upper region and a lower region, a layer of erasing material having a top portion and a bottom portion, the top portion affixed to the lower region of the eraser body, at least one socket on the upper region for accommodating at least a portion of a writing utensil, and a magnetic member operatively engaged to the eraser body between the top portion of the layer of erasing material and the upper region of the eraser body.

DETAILED DESCRIPTION OF THE PREFERRED EMBODIMENT

Figure 1:
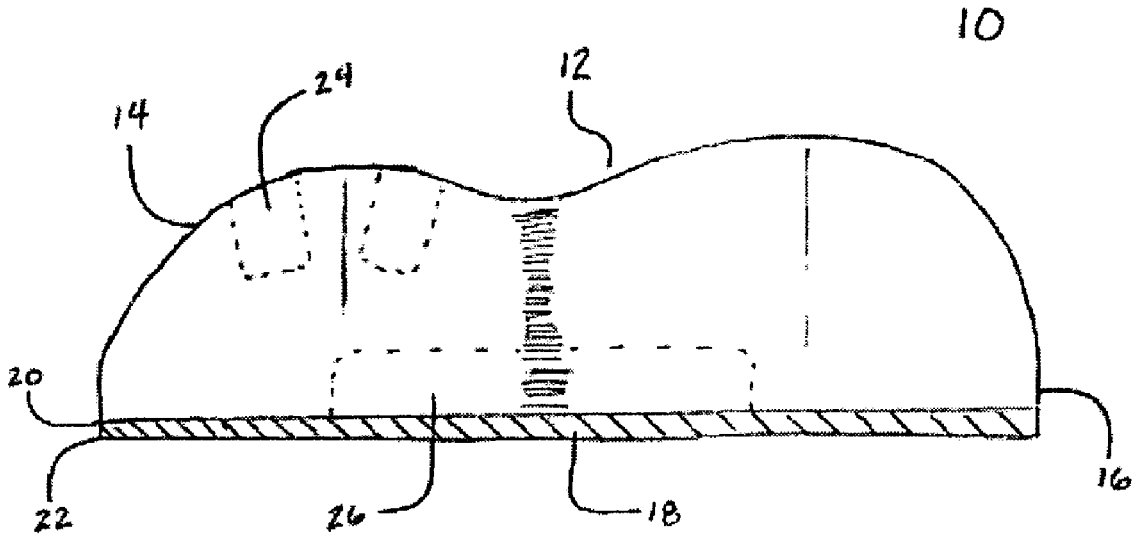
FIG. 1 is a side view illustration of the preferred embodiment of the present invention.

Referring now to FIG. 1, a preferred embodiment of the present invention is illustrated as dry eraser 10. Dry eraser 10 includes an eraser body 12 having an upper region 14 and a lower region 16. Eraser body 12 can be formed from any one of a number of materials, including but not limited to plastics, polymers, woods, or metals. It is preferred that the material forming eraser body 12 be lightweight, so that it can be easily suspended and supported as detailed below. Furthermore, eraser body 12 shaped in a vast array of well known configurations, including but not limited to ergonomic shapes for user comfort, animal shapes, such as mammals, fish, reptiles, birds, and insects, and vehicle shapes, such as automobiles, trucks, aircraft, and ships.

Figure 4:
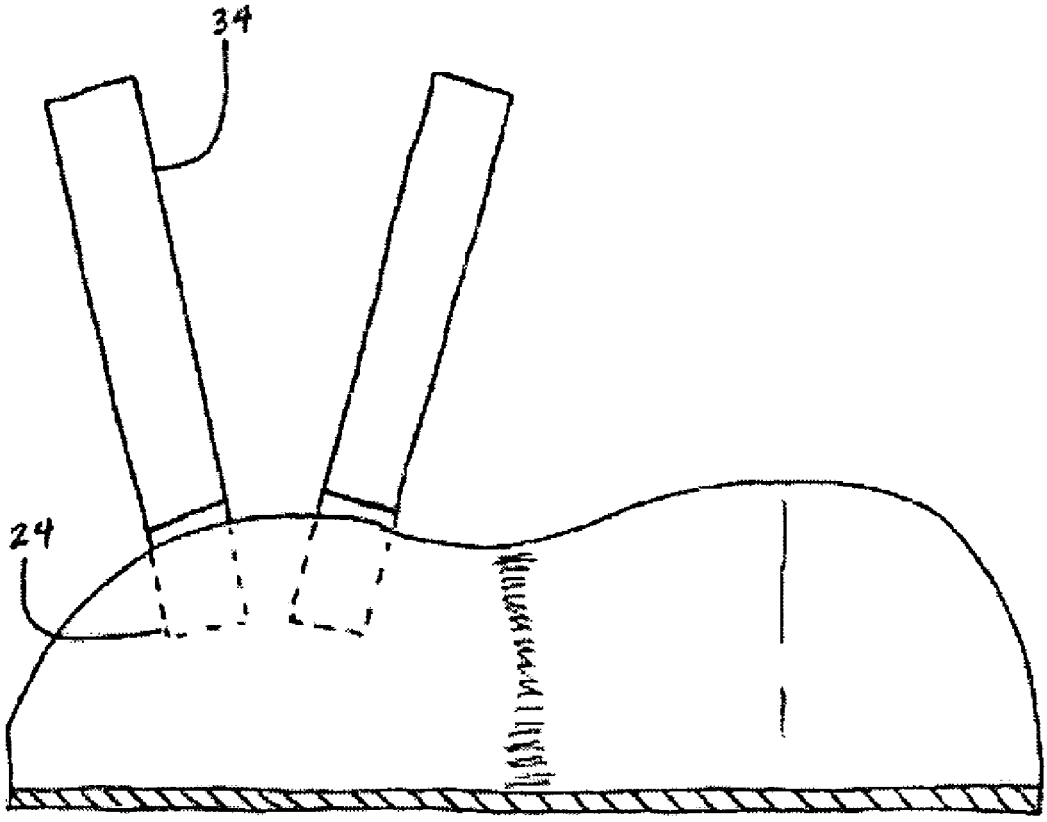
FIG. 4 is a side view illustration of the present invention of FIG. 1 in use.

As shown in FIG. 1, upper region 14 includes at least one socket 24 for accommodating a writing utensil (shown in FIG. 4 as writing utensil 34). At least one socket 24 engages a writing utensil, preferably forming a friction fit to secure the writing utensil. In this way, a user can simultaneously employ dry eraser 10 and have access to the writing utensil. Alternatively, at least one socket 24 can form the cap of writing utensil. Dry eraser 10 can accommodate several writing utensils, presenting them in an easy to grip manner due to their orientation to the user. At least one socket 24, and therefore the writing utensils, can be positioned in a variety of orientations, preferably in an orientation that is substantially perpendicular to a longitudinal axis of eraser body 12. In the present invention, the term "substantially perpendicular" is meant to convey at least one socket 24 allows an associated writing utensil to project outward from eraser body at an angle that is not parallel to the longitudinal axis of eraser body 12. Such an angle can be from about 10° to about 170° from the longitudinal axis. Thus, the writing utensil has a location to reside that is extremely convenient to the user, reducing the likelihood of its loss, and is simple to grasp due to its orientation with respect to eraser body 12.

Figure 3:
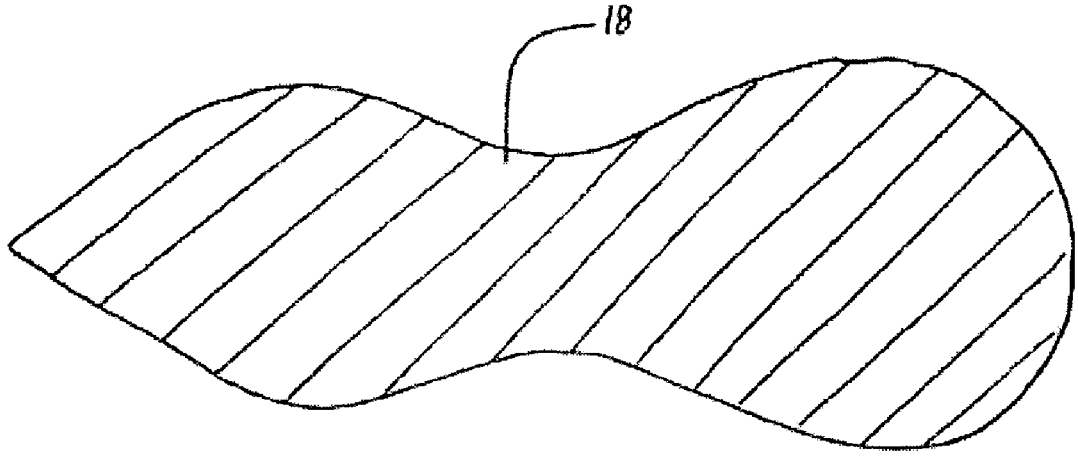
FIG. 3 is a bottom view illustration of the present invention of FIG. 2.

Lower region 16 provides a location for layer of erasing material 18 to be affixed, thereby providing the for the erasing function of dry eraser 10. Layer of erasing material 18 can be any one of the numerous erasing materials known in the art and can be washable and/or replaceable. Layer of erasing material 18 includes a top portion 20 and a bottom portion 22. Top portion 20 is affixed to lower region 16 by any one of the number of affixing techniques known in the art, including but not limited to adhesives and fasteners (such as staples, tacks, and the like). Bottom portion 22 provides for the erasing function of dry eraser 10, and, as illustrated in FIG. 3, is preferably shaped to conform to the shape of lower region 16 of eraser body 12.

Figure 5:
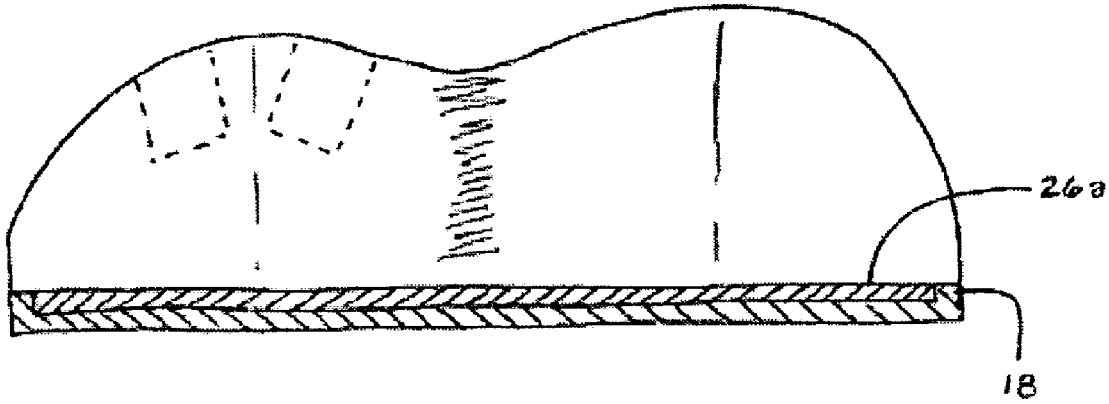
FIG. 5 is a side view illustration of an alternative embodiment of the present invention of FIG. 1.

Additionally, lower region 16 accommodates magnetic member 26. The accommodation of magnetic member 26 can be accomplished by cutting out a portion of lower region 16 of eraser body 12 or by forming eraser body 12 with an area sufficient to accommodate magnetic member 26, or by any manner known in the art. Alternatively, as shown in FIG. 5, magnetic member **26*a* can be affixed directly to lower region 16 and covered by layer of erasing material 18**.

Magnetic member 26 functions to imbue dry eraser 10 with the ability to magnetically engage a substrate capable of magnetic engagement. Such substrates are frequently positioned behind a white dry erase board (not shown) for additional support. As a result, dry eraser 10 is capable of "sticking" to a white dry erase board due to the magnetic bond between magnetic member 26 and the substrate behind the white dry erase board.

Figure 2:
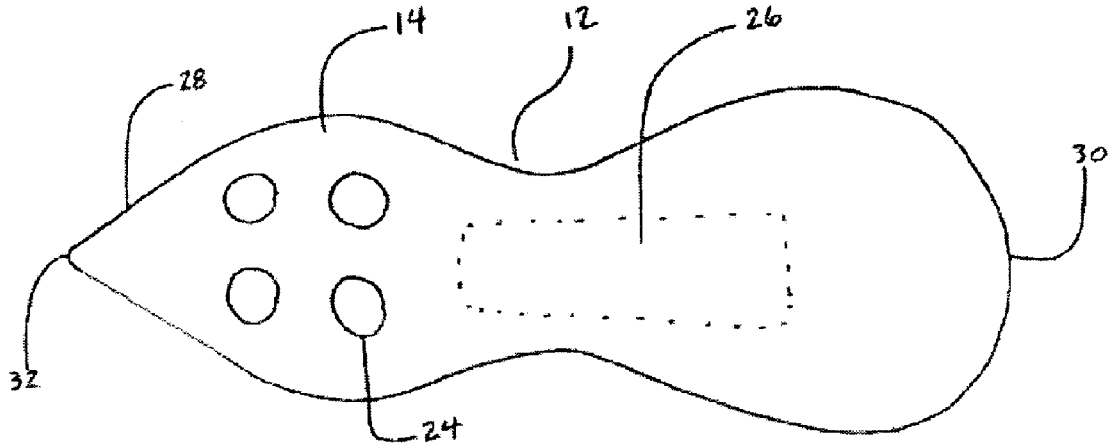
FIG. 2 is a top view illustration of the present invention of FIG. 1.

Referring now to FIG. 2, eraser body 12 is illustrating further including a first end 28 and a second end 30. Preferably, the user grips eraser body 12 on upper region 14, extending from second end 30 towards first end 28. In this way, at least one writing utensil positioned within at least one socket 24 is easily and readily accessible. First end 28 terminates into point 32, point 32 capable of making more fine and accurate erasures than a broad edge used in typical erasers.

Although only a few exemplary embodiments of the present invention have been described in detail above, those skilled in the art will readily appreciate that numerous modifications are to the exemplary embodiments are possible without materially departing from the novel teachings and advantages of this invention. Accordingly, all such modifications are intended to be included within the scope of this invention as defined in the following numbered claims.

What is claimed is:

1. A dry eraser in combination with a writing utensil for releasably attaching to a substantially vertical surface, the dry eraser comprising:

an eraser body having a longitudinal axis, an upper region and a lower region;

a layer of erasing material having a top portion and a bottom portion, said top portion affixed to said lower region of said eraser body;

at least one socket on said upper region, wherein the at least one socket comprises a cap for accommodating a first tip of the writing utensil such that the writing utensil is oriented substantially perpendicularly to the longitudinal axis of the eraser body when coupled with the cap and extending therefrom; and a magnetic member operatively engaged to said eraser body between said top portion of said layer of erasing material and said upper region of said eraser body.

2. The dry eraser of claim 1 wherein said layer of erasing material is affixed to said magnetic member.

3. The dry eraser of claim 1 wherein said eraser body further includes a first end and a second end.

4. The dry eraser of claim 3 wherein said first end terminates in a point.

5. The dry eraser of claim 1 wherein said at least one socket is substantially perpendicular to a longitudinal axis of said eraser body.

6. The dry eraser of claim 1 wherein said eraser body has a shape of an animal.

7. The dry eraser of claim 6 wherein said shape is selected from the group consisting of fish, reptiles, dinosaurs, birds, and insects.

8. The dry eraser of claim 1 wherein said eraser body has a vehicle shape.

9. The dry eraser of claim 8 wherein said vehicle shape is selected from the group consisting of automobiles, trucks, aircraft, and ships.

10. A dry eraser in combination with a marker for use with a dry eraser board comprising:

an eraser body having an upper region, a lower region and a longitudinal axis;

a layer of erasing material affixed to said eraser body;

the marker including a body and a tip comprising a working end of the marker;

at least one socket on said upper region for accommodating the tip of the marker, the at least one socket comprising a cap, wherein the marker tip fits securely within the at least one socket so as to orient the marker substantially perpendicularly to the longitudinal axis of the eraser when the body of the marker is coupled with the at least one socket; and a magnetic member operatively engaged to said eraser body between said top portion of said layer of erasing material and said upper region of said eraser body.

* * * * *